United States Patent [19]

Sakamaki et al.

[11] 4,396,363

[45] Aug. 2, 1983

[54] SMALL RECIPROCATING PUMP

[75] Inventors: Hiroshi Sakamaki, Utsunomiya; Susumu Sugishita, Hanyu; Yukio Horikoshi, Kazo, all of Japan

[73] Assignee: Nippon Piston Ring Co., Ltd., Tokyo, Japan

[21] Appl. No.: 301,862

[22] Filed: Sep. 14, 1981

[30] Foreign Application Priority Data

Sep. 16, 1980 [JP] Japan ..... 55-127293

[51] Int. Cl.[3] ..... F04B 39/10

[52] U.S. Cl. ..... 417/439; 417/571

[58] Field of Search ..... 417/571, 569, 570, 565, 417/439; 92/169

[56] References Cited

U.S. PATENT DOCUMENTS

| | | | |
|---|---|---|---|
| 756,529 | 4/1906 | Rose | 417/571 |
| 3,131,855 | 5/1964 | Kocher | 417/439 X |
| 3,431,865 | 3/1969 | Cook et al. | 417/571 X |
| 3,456,874 | 7/1969 | Graper | 417/571 X |
| 4,360,319 | 11/1982 | Paget | 417/571 X |

*Primary Examiner*—Edward K. Look

*Attorney, Agent, or Firm*—Sughrue, Mion, Zinn, Macpeak and Seas

[57] ABSTRACT

In a small reciprocating pump, an annular space is provided between a cylinder and a cylinder block. The cylinder is bifurcated at its upper end, and has two projecting edges. One of these projecting edges is radially outwardly spaced apart from the other, and greater in length than the other. A cylinder head has a lower surface provided with an annular groove in which the outer projecting edge of the cylinder is engaged. A seal ring is disposed in this annular groove, and another seal ring between the projecting edges of the cylinder to maintain the cylinder in gastight contact with the cylinder head. The other seal ring also serves to support a metal plate which forms therein a valve. The cylinder head is provided with an intake passage having an intake valve, and a discharge passage having a discharge valve. The cylinder block is connected to a crank case in a gastight fashion. A crankshaft is supported rotatably in the crank case for reciprocating a piston in the cylinder.

6 Claims, 5 Drawing Figures

SMALL RECIPROCATING PUMP

BACKGROUND OF THE INVENTION

1. Field of the Invention

This invention relates to a small reciprocating pump. In particular, it relates to a pump which is suitable for installation in a refrigerant device for an air conditioner for compressing a refrigerant such as Freon.

2. Description of the Prior Art

A known prior art pump has a large clearance volume when compared with its stroke volume, whether it may be of the plunger or piston type. Moreover, the temperature of its compression chamber is likely to be elevated owing to the influence of its environment. A vaporized refrigerant is therefore not fully liquified in such a system. Thus, such a pump lacks stability in operation.

This invention is concerned with specifically a pump for compressing a refrigerant. It is basically equal in construction to a reciprocating pump employed most commonly in the art. While a known pump for compressing a refrigerant discharges in the form of a vapor-liquid mixture, however, this invention is directed to a pump of the type which discharges a refrigerant in a fully liquefied form. No known reciprocating pump can liquefy a refrigerant completely. The known plunger pump is disclosed, for example, in U.S. Pat. No. 3,538,961, and a special pump is disclosed in Japanese Patent Publication No. 27366/77. None of these known pumps has been put to mass production and practical use, since they cannot liquefy a refrigerant completely and are too complex in construction.

SUMMARY OF THE INVENTION

It is an object of this invention to provide a compact reciprocating fluid pump having none of the drawbacks hereinabove pointed out.

It is another object of this invention to provide a compact reciprocating fluid pump to handle liquid refrigerant in air conditioning systems.

According to the essential features of this invention, an annular clearance space is provided between a cylinder and a cylinder block for maintaining thermal insulation. The cylinder has a bifurcated upper end to provide a double seal ring and a cylinder head has an annular groove in which one of the bifurcated end portions of the cylinder and a seal ring engaged to connect the cylinder and the cylinder head in a gastight fashion. The pump can liquefy a refrigerant completely.

It is necessary to prevent any air-conditioner refrigerant, such as Freon, from leaking out into the open atmosphere, since such leakage is likely to cause environmental pollution. The sealing arrangement for the cylinder as hereinabove described prevents leakage of the refrigerant almost completely. Moreover, as an added safety feature, it is desirable to have a crankshaft supported on a crank case in a gastight fashion to prevent any leakage along the crankshaft of the refrigerant flowing out of the cylinder into the crank chamber.

This invention will be described in greater detail by reference to the drawings and the description of the preferred embodiment that follows.

DESCRIPTION OF THE PREFERRED EMBODIMENT

Figure 1:
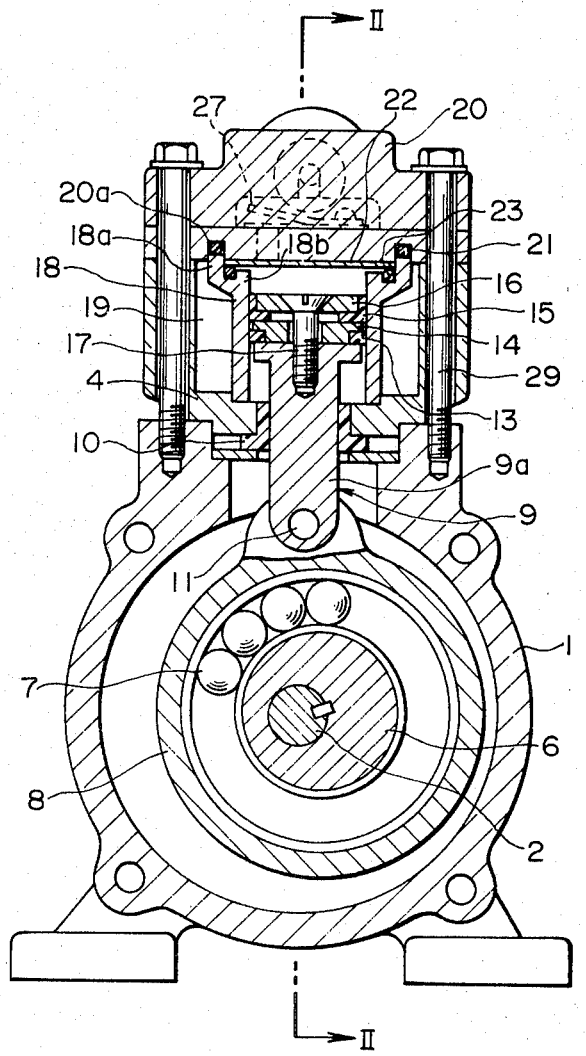
FIG. 1 is a vertical sectional view of a pump embodying this invention.
Figure 2:
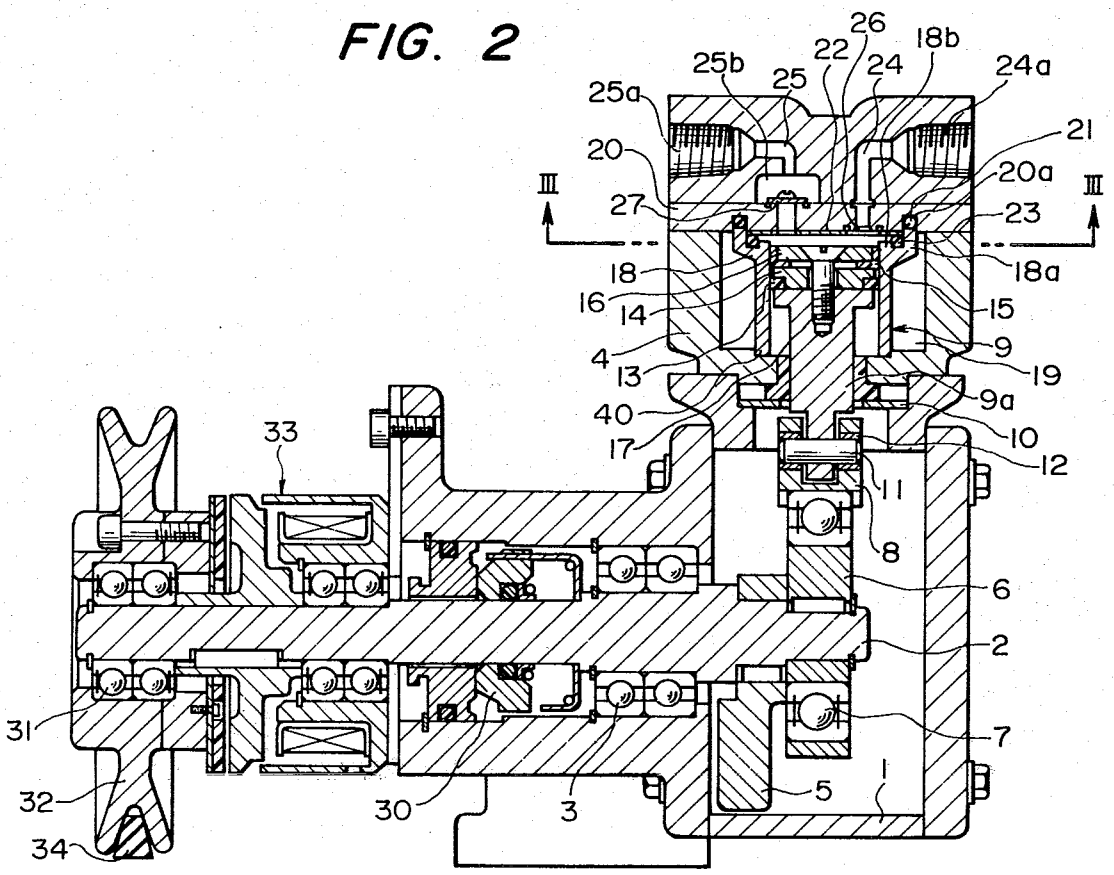
FIG. 2 is a sectional view taken along the line II—II of FIG. 1; but showing a piston at the top dead center.
Figure 5:
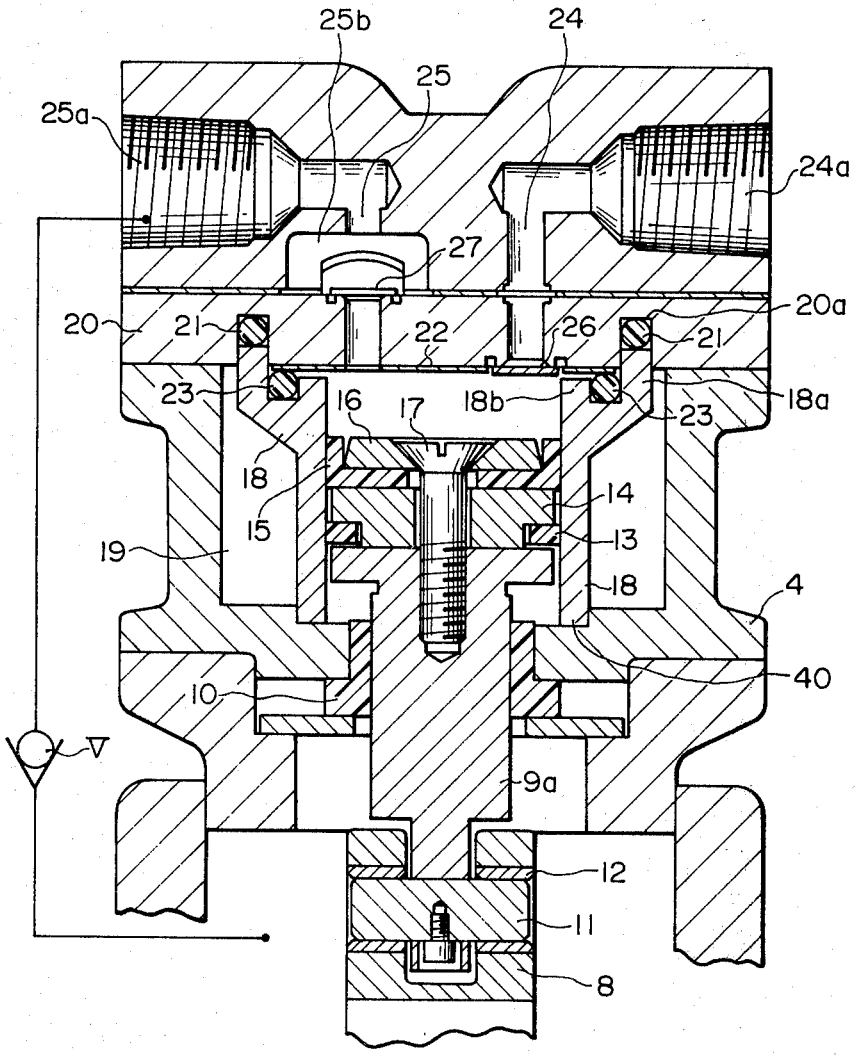
FIG. 5 is a fragmentary enlarged view of FIG. 2.

Referring to FIGS. 1, 2 and 5 of the drawings, a crankshaft 2 is supported by bearings 3 in a crank case 1. A cylinder block 4 and a cylinder head 20 are connected to the crank case 1 by bolts 29 in a gastight fashion. A balance weight 5 and a crank rotor 6 are keyed to the inner end of the crankshaft 2 projecting into a crank chamber defined by the crank case 1. A connecting roller 8 is mounted on a crank rotor 6 by bearings 7. A rod 9*a* projects downwardly through the center of the cylinder block 4, and a synthetic resin packing member 10 having an L-shaped cross section is disposed between the cylinder block 4 and the rod 9*a*. The L-shaped packing ring 10 serves to guide a piston 9 as well as to provide sealing function for preventing fluid from leaking into the crank case 1. The rod 9*a* has a lower end attached to the connecting roller 8 by a pin 11 and synthetic resin bearings 12.

A synthetic resin ring 13 having a rectangular cross section, a ring holder 14, a synthetic resin ring 15 having an L-shaped cross section, and a washer 16 are disposed one upon another on the upper end of the rod 9*a*. They are connected together by a flush head screw 17 to define in combination a piston 9. The L-shaped ring 15 provides sufficient sealability against high pressure. Further, because of co-use of the L-shaped ring 15 and the ring 13, the fluid leakage into the crank case 1 can be greatly reduced. A cylinder 18 is received in the cylinder block 4, and has an inner surface along which the ring 13 having a rectangular cross section and the ring 15 having an L-shaped cross section are sliable.

An annular clearance space 19 is provided between the cylinder block 4 and the cylinder 18. The cylinder 18 has a bifurcated upper end defined by an inner end portion 18*b* and an outer end portion 18*a* which is greater in projecting length than the inner end portion 18*b*. The cylinder head 20 has an annular groove 20*a* in which the outer end portion 18*a* of the cylinder 18 is engaged, and a seal ring 21 is disposed between the cylinder head 20 and the outer end portion 18*a*. A metal plate 22 is positioned on a lower surface portion of the cylinder head 20 encircled by the cylinder 18. The metal plate 22 has an outside diameter which is substantially equal to the inside diameter of the annular groove 20*a*. A seal ring 23 is engaged between the bifurcated outer end portion 18*a* and inner end portion 18*b* of the cylinder 18, and maintained in intimate contact with the metal plate 22.

Figure 4:
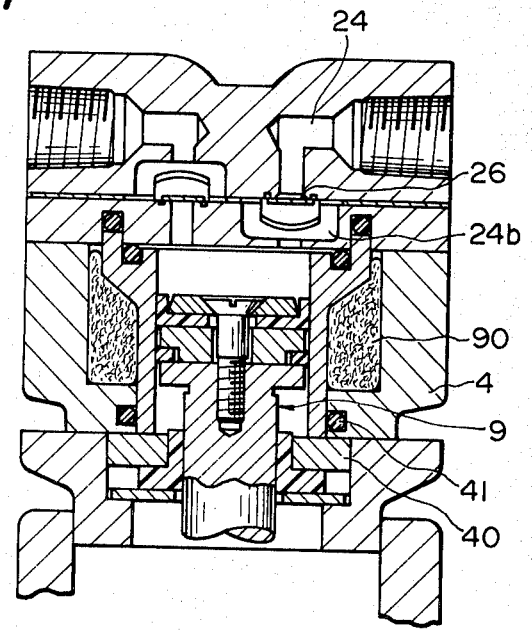
FIG. 4 is a fragmentary enlarged vertical sectional view showing another embodiment of this invention.

The cylinder head 20 is provided with an intake port 24*a* and a discharge port 25*a* connected to an intake passage 24 and a discharge passage 25, respectively, leading to the metal plate 22. A lead valve 26 is provided at the outlet opening of the intake passage 24 facing the metal plate 22. The discharge passage 25 has an enlarged space 25*b* intermediate the ends thereof, and a lead valve 27 is provided in the space 25*b*. The cylinder 18 has a lower end 40 that is engaged with the cylinder block 4. It is desirable to provide a seal ring 41 between the lower end 40 of the cylinder 18 and the cylinder block 4 as shown in FIG. 4.

A mechanical seal 30 is disposed between the crank case 1 and the crankshaft 2 outwardly of the bearings 3. A pulley 32 is supported by bearings 31 on the outer end of the crankshaft 2. An electromagnetic clutch 33 engaging the pulley 32 has an output port keyed to the crankshaft 2. A belt 34 is provided to transmit rotation of an electric motor not shown to the pulley 32 to operate the pump.

Figure 3:
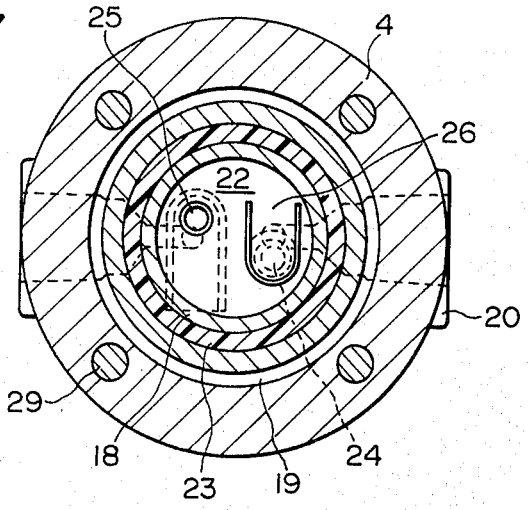
FIG. 3 is an enlarged sectional view taken along the line III—III of FIG. 2.

The metal plate 22 comprises an elastic metal plate. The lead valve 26 provided at the opening of the intake passage 24 comprises a portion of the metal plate 22 cut in the form of a tongue as shown in FIG. 3. This arrangement reduces the clearance volume of the cylinder 18, and renders the cylinder head 20 compact in construction. The valve seat 22 is maintained in contact with the cylinder head 20 by the seal ring 23 in the bifurcated end portions of the cylinder 18. The annular space 19 between the cylinder block 4 and the cylinder 18 prevents any heat-flow from the cylinder block 4 to the piston chamber. If required, optionally the annular space 19 may be filled with insulating material 90, as shown in FIG. 4, to provide a higher degree of thermal insulation. The metal plate 22 is formed with a simple hole defining an opening for the discharge passage 25.

The lead valve 26 for the intake passage 24 does not necessarily need to be formed integrally with the metal plate 22, in case where displacement of the pump is greatly large and an internal volume of the space **24*b* is greatly smaller than the displacement. It is possible to provide a space 24*b* in the intake passage 24, and dispose a separate lead valve 26 therein, as shown in FIG. 4**.

The pump of this invention is small enough to be easily installed in a refrigerant device for an air conditioner. The cylinder is compact in construction and the pump is easy to assemble if the outer end portion **18*a* of the cylinder 18 is engaged in the annular groove 20*a* of the cylinder head 20**.

In operation, the motor is started to rotate the pulley 32, and the electromagnetic clutch 33 is engaged to rotate the crankshaft 2 and the connecting roller 8, whereby the piston 9 is vertically reciprocated. When the piston 9 moves down, the valve 27 closes, and the valve 26 opens to permit a fluid, such as Freon, to flow into the piston chamber through the intake port **24*a* and the intake passage 24. If the piston 9 rises, the valve 26 closes, and the valve 27 opens to permit the compressed fluid to be discharged from the piston chamber through the discharge passage 25 and the discharge port 25*a***.

Even if the pump is installed in a high temperature environment, the heat insulating space 19 provided between the cylinder block 4 and the cylinder 18 prevents any undue rise of the temperature of the cylinder 18. Therefore, the refrigerant, such as Freon, flowing into the cylinder 18 does not vaporize, but the pump can continue to operate in a satisfactory condition. Even if the ambient temperature is so high that a part of the refrigerant vaporizes before entering the cylinder 18, the clearance volume of the cylinder 18 is sufficiently small to provide the necessary pressure for liquefying the vaporized fluid, so that the pump may discharge the refrigerant in a completely liquid form. It follows that the total quantity of the refrigerant to be discharged is proportional to the total number of revolutions of the pump. Therefore, it is possible to feed an air conditioner, or the like with the necessary quantity of the refrigerant by monitoring the length of time for which the pump is operated.

The seal rings 21 and 23 define a double seal between the cylinder 18 and the cylinder head 20. This double seal prevents any leakage of the refrigerant, and maintains the necessary pressure for liquefying any vaporized refrigerant. The mechanical seal 30 prevents any refrigerant flowing down between the piston 9 and the cylinder 18 into the crank case 1 from escaping along the crankshaft 2. If the refrigerant continues to flow into the crank case 1, the pressure of the refrigerant therein becomes substantially equal to that prevailing in the piston chamber, and the refrigerant ceases to flow into the crank case 1. In this connection, it is possible to establish a certain amount of fluid pressure positively in the crank chamber by, for example, providing a passage between the intake or discharge passage, and the crank chamber as shown in FIG. 5. In the event any such passage is provided between the discharge passage and the crank chamber, it is necessary to provide a check valve V in the passage.

As hereinabove described in detail, the pump of this invention is compact in construction, easy to assemble, and free from any danger of fluid leakage. Therefore, it can most advantageously be used for feeding an air conditioner, or the like with a refrigerant, such as Freon to prevent any environmental pollution that may otherise result from leakage of Freon. The refrigerant hardly vaporizes in the cylinder, since it is thermally insulated from its environment, and has only a small clearance volume. Even if any refrigerant may vaporize when flowing into the cylinder, it is fully liquefied therein. Therefore, the pump can always be operated in a satisfactory condition to discharge the compressed refrigerant at a precisely controlled rate. As is obvious from the foregoing description, this invention provides a high-performance small reciprocating pump which can also be advantageously employed for other purposes than those hereinabove specifically mentioned.

What is claimed is:

1. In a reciprocating pump of the type having a crankshaft rotated for reciprocating a piston in a piston chamber in a cylinder, the improvement comprising:

said cylinder secured in a cylinder block, said cylinder and said cylinder block defining an annular space therebetween, said cylinder being bifurcated at its upper end and having a pair of projecting edges, one of which is greater in length than the other;

a cylinder head having a lower surface provided with an annular groove in which said projecting edge of greater length is engaged;

a first seal ring provided between said projecting edges;

a second seal ring in said annular groove, said first and second seal rings maintaining said cylinder in gastight contact with said cylinder head;

said cylinder head having an intake passage having an intake valve, and a discharge passage having a discharge valve; and a crank case to which said cylinder block is connected in a gastight fashion, and in which said crankshaft is rotatably supported.

2. A reciprocating pump as set forth in claim 1, wherein said one projecting edge of greater length is radially outwardly spaced apart from said other projecting edge, said pump further including a circular metal plate resting on said lower surface of said cylinder head, said metal plate comprising an elastic metal plate having an outside diameter substantially equal to the inside diameter of said annular groove, said metal plate having an integrally formed lead valve defining said intake valve to communicate said intake passage with said cylinder, said metal plate being supported by said first seal ring and having a hole defining an opening through which said discharge passage is in fluid communication with said cylinder.

3. A reciprocating pump as set forth in claim 2, further comprising a mechanical seal provided between said crank case and said crankshaft, said crankshaft projecting outwardly from said crank case through said mechanical seal.

4. A reciprocating pump as set forth in claim 1, further comprising a passage connecting said crank case with one of said intake and discharge passages.

5. A reciprocating pump as set forth in claim 1, further comprising insulating material disposed in said annular space to insulate said piston chamber.

6. A reciprocating pump as set forth in claim 1, further comprising a synthetic resin ring having L-shaped crosssection, a resin ring having a rectangular cross section, a washer disposed between said L-shaped ring and said rectangular ring, and a resin packing member having L-shaped cross-section adapted to seal between said crank case and said cylinder block, said first L-shaped ring, said washer and said rectangular ring being disposed within said cylinder to provide a portion of said piston.

* * * * *